US006126147A

United States Patent [19]

Fingerson et al.

[11] Patent Number: 6,126,147

[45] Date of Patent: Oct. 3, 2000

[54] FENCE POST APPARATUS

[75] Inventors: Conrad F. Fingerson, Chatfield; Gerhard Ray Hylland, Stewartville; Lawrence Lester Lange, Chatfield, all of Minn.

[73] Assignee: Geotek, Inc., Stewartville, Minn.

[21] Appl. No.: 08/961,161

[22] Filed: Oct. 30, 1997

Related U.S. Application Data

[63] Continuation-in-part of application No. 08/593,530, Jan. 24, 1996, Pat. No. 5,697,600.

[51] Int. Cl.[7] ..... E04H 17/22

[52] U.S. Cl. ..... 256/64; 256/DIG. 5; 52/157

[58] Field of Search ..... 256/36, 35, 64, 256/DIG. 5, 63, 31; 52/154, 156, 157

[56] References Cited

U.S. PATENT DOCUMENTS

| | | | |
|---|---|---|---|
| 299,770 | 6/1884 | Fischer . | |
| 598,003 | 1/1898 | Oliver . | |
| 755,413 | 3/1904 | Terry . | |
| 1,764,207 | 6/1930 | Johnson . | |
| 1,894,401 | 1/1933 | Hollos | 52/154 |
| 1,911,483 | 5/1933 | Thompson . | |
| 2,799,369 | 7/1957 | Walton | 256/36 |
| 3,011,597 | 12/1961 | Galloway et al. | 52/153 |
| 3,011,598 | 12/1961 | Galloway et al. . | |
| 4,580,795 | 4/1986 | Burtelson et al. | 52/157 X |
| 4,803,812 | 2/1989 | Alexander, Sr. . | |
| 4,833,846 | 5/1989 | McFeetors et al. | 52/154 |
| 4,893,787 | 1/1990 | Watson | 52/154 X |
| 4,923,165 | 5/1990 | Cockman . | |
| 5,011,107 | 4/1991 | Reece . | |
| 5,139,235 | 8/1992 | Kilmer . | |
| 5,662,304 | 9/1997 | McDaniel | 52/157 X |
| 5,697,600 | 12/1997 | Fingerson et al. | 256/64 |

FOREIGN PATENT DOCUMENTS

| | | |
|---|---|---|
| 1383253 | 11/1964 | France . |
| 635152 | 3/1983 | Switzerland . |

*Primary Examiner*—Terry Lee Melius
*Assistant Examiner*—John R. Cottingham
*Attorney, Agent, or Firm*—Merchant & Gould P.C.

[57] ABSTRACT

The preset invention is a fence post apparatus. The fence post apparatus has an upright member and support member. The support member includes a support post and a support auger. The support post is coupled to the upright member and the support auger is adjustably coupled to the support post such that the position of the support auger with respect to the support post may be adjusted.

11 Claims, 5 Drawing Sheets

FENCE POST APPARATUS

The present application is a continuation-in-part of U.S. application Ser. No. 08/593,530, filed Jan. 24, 1996 now U.S. Pat. No. 5,697,600, entitled "Fence Post Apparatus".

FIELD OF THE INVENTION

The present invention relates generally to fence post apparatus, and more particularly, to corner fence post apparatus having auger bases.

BACKGROUND OF THE INVENTION

The installation of fence posts has always been a difficult, tedious job requiring specialized tools and intensive labor. Most commonly, fence posts have been installed by using hand digging implements to dig a hole into which a fence post is then inserted. Earth removed from the hole during digging is subsequently repacked around the installed post. Fence posts installed by this method are subject to lateral instability until the earth settles around the post and upon settling, an undesirable and problematic depression is typically found around the base of the post.

In an alternative method of installation, a weighted ram or driver is used to pound fence posts directly into the ground without first making a hole. Due to the extreme force applied to the upper most end of the post, this installation method is not suitable for posts having ornamental tops, or posts having irregular shapes or high length to diameter ratios, which may split or deform respectively.

In an attempt to facilitate fence post installation an auger base arrangement has been used. Auger arrangements typically include a post and an auger base having a helical blade and a shaft, which is connected to the lower end of the post. The post typically receives the shaft and is connected thereto with a pin or a bolt. Though alleviating some of the disadvantages associated with the aforementioned installation methods, auger arrangements have been associated with a number of drawbacks. For example, the pin or bolt connection between the post and shaft can result in splitting of the lower end of the post. Moreover, the pointed leading edge of the helical blade can pick into rocks or other obstructions, thus preventing the auger from moving deeper into the ground. This can be a burdensome problem in rocky soils.

To provide lateral support for fence posts, the depth to which a base is installed is typically relatively deep in proportion to the above-ground height of the post. Installing a post to such depth is a burdensome task in general, and excessively so in hard clay or rocky soils. To over come such installation depths and to further provide lateral support, anchoring posts have been provided. Anchoring posts are installed at angles to the main post, and preferably have their top ends connected to the main post. Using conventional fence post apparatus and installation methods, anchoring posts are difficult to employ. For example, in conventional corner fence post systems using anchoring posts and auger base arrangements, e.g., U.S. Pat. No. 5,139,235 to Kilmer, if an anchor post auger base cannot reach a desired depth due to an obstacle, e.g. a rock, the top end of the anchor post cannot be readily connected to the main post.

As a result there is an intensely felt need in the fence post industry for a durable and easily installable fence post apparatus. The present invention addresses this need as well as other needs.

SUMMARY OF THE INVENTION

The present invention is a fence post apparatus. The fence post apparatus has an upright member and support member.

The support member includes a support post and a support auger. The support post is coupled to the upright member and the support auger is adjustably coupled to the support post such that the position of the support auger with respect to the support post may be adjusted.

DETAILED DESCRIPTION OF THE EMBODIMENTS

Figure 1:
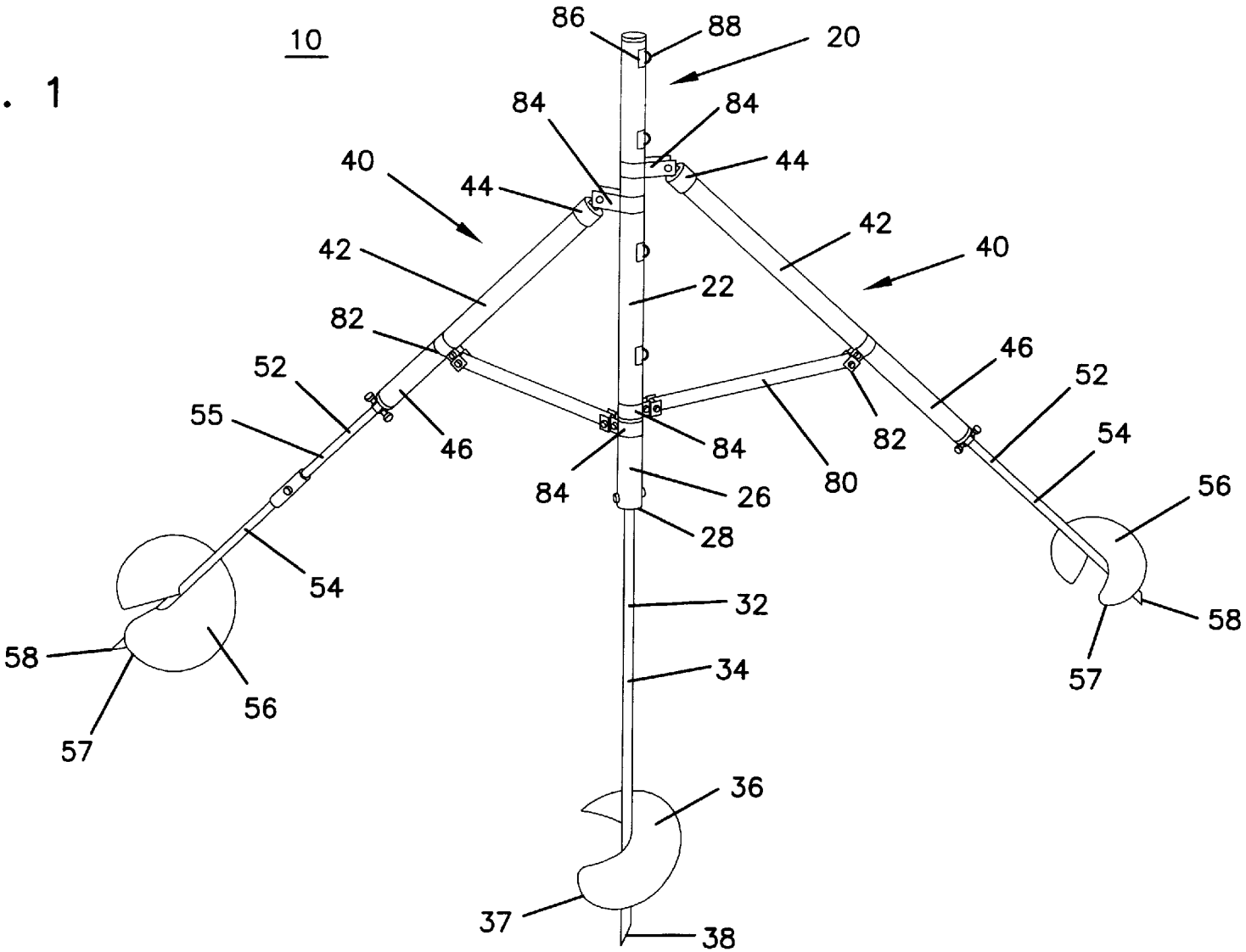
FIG. 1 is a perspective view of an embodiment of a corner fence post apparatus in accordance with the principles of the present invention.

Referring now to the drawings, and more particularly to FIG. 1, an exemplary corner fence post apparatus 10 is shown. The fence post apparatus 10 includes a corner member 20 and two support members 40. The corner member 20 includes a post 22 and an auger base 32. The support members 40 each include a post 42 and auger base 52. The fence post apparatus 10 may further include braces 80 interconnected between the support posts 42 and the corner post 22. It is noted that the illustrated corner fence post apparatus 10 is exemplary only. The present invention extends to cover single fence posts, non-corner fence post apparatus, and corner fence post apparatus having any number of support posts.

Corner member 20 includes a lower end portion 26 and a lower edge 28. The corner post 22 may be constructed of electrically insulating material suitable for use in electric fencing system, for example, fiberglass or polyvinylchloride (PVC) tubing. The corner post 22 may have an outer diameter of one and one-quarter to three inches with a wall thickness of one-eighth to one-half of an inch. In other embodiments, the corner post 22 may be constructed of wood or metals such as steel or wrought iron.

Figure 4:
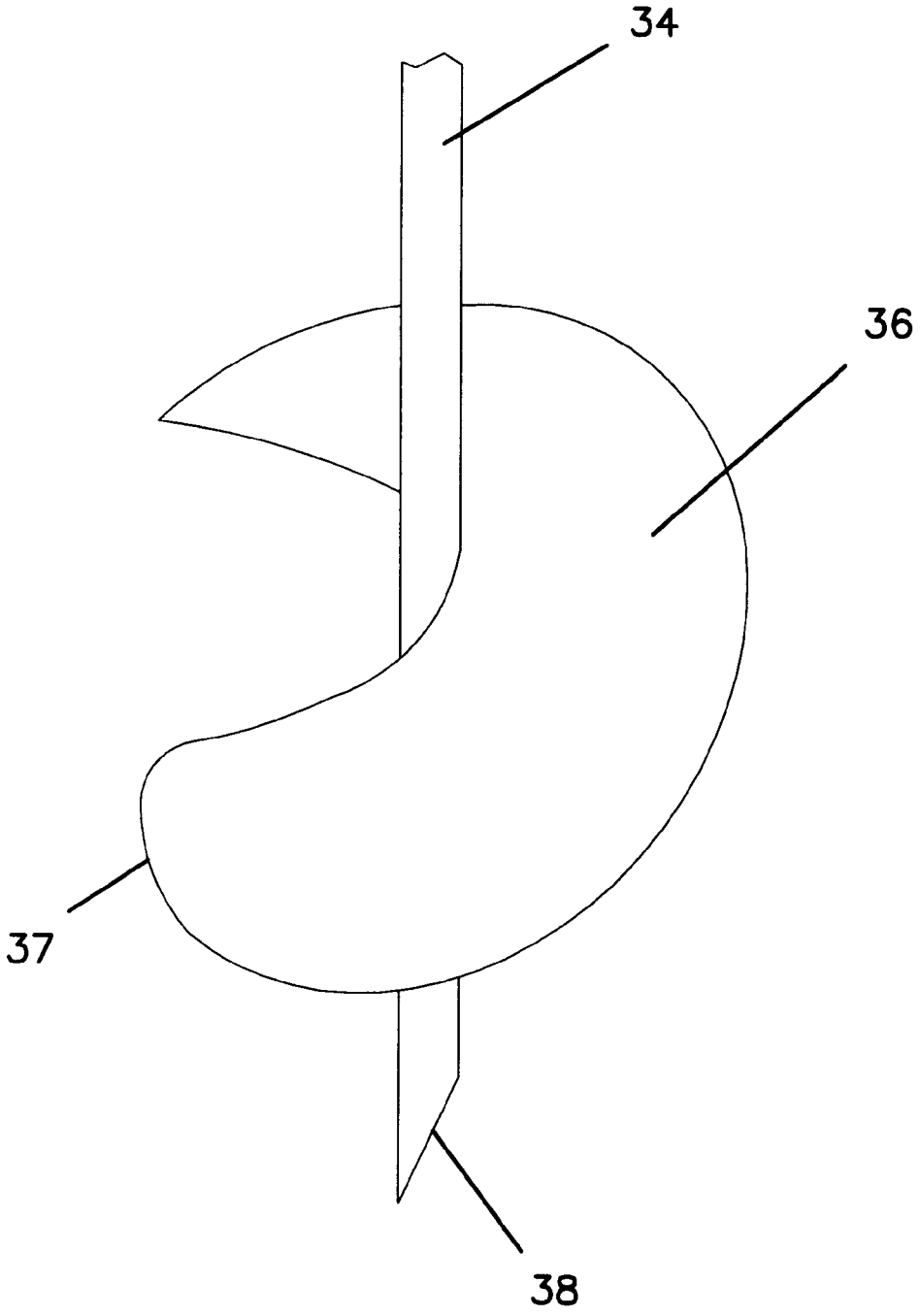
FIG. 4 is a perspective view of an embodiment of an auger blade in accordance with the principles of the present invention.

The corner auger base 32 typically includes an a elongated shaft 34 and a helical blade 36. The shaft 34 may be constructed of any suitable material, including steel, or a corrosion resistant material and may have a diameter of one-half of an inch to two inches, for example. The length of shaft 34 will vary with its desired depth, and may be, for example, 36 inches. Extensions 55 may be added to allow deeper penetration into the ground for greater holding power. To facilitate advancement of the auger base 32 into the ground, the shaft 34 may include a beveled end 38, and the helical blade 36 may be provided with a rounded leading edge 37, as best shown in FIG. 4.

Figure 3A:
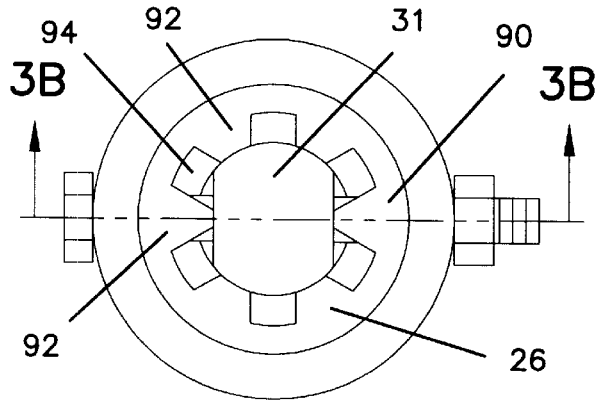
FIGS. 3A and 3B are horizontal and vertical cross-sectional views of the connecting portion of the corner member shown in FIG. 1.
Figure 3B:
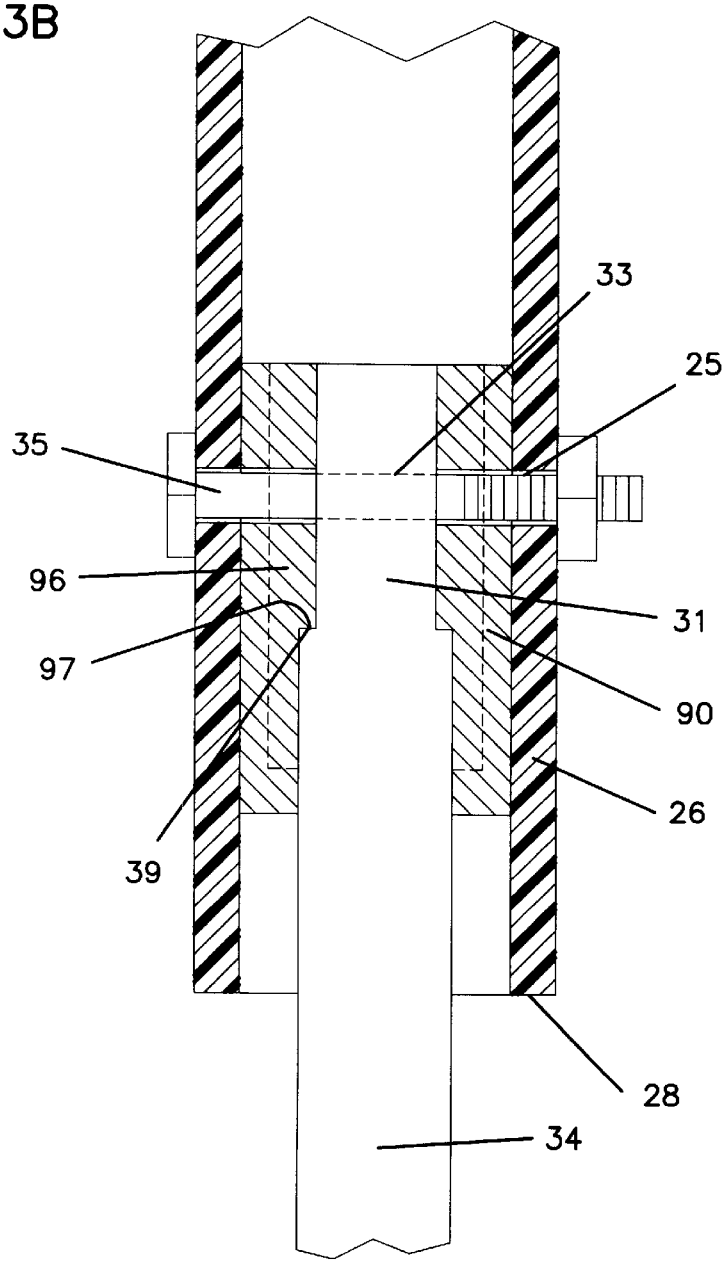

The shaft 34 of the auger base 32 may be coupled to the lower portion 26 of the corner post 22 using any number of coupling arrangements, including bonding, riveting, bolting, press-fitting, etc. In the exemplary embodiment, best shown in FIGS. 1 and 3, the auger base 32 is received by the corner post 22 and connected thereto using a fastener 35, such as a bolt or pin, for example. The fastener 35 may be disposed through a bore 33 in the auger shaft 34 and a bore 25 in the corner post 22. The diameter of the fastener 35 and bores 33 and 25 may be on the order of five-sixteenths of an inch, for example.

To facilitate insertion of the fastener 35, a mechanism may be employed to align bores 33 and 25. In the exemplary embodiment, best illustrated in FIGS. 3A and 3B, the shaft 34 is provided with an upper end portion 31 having a non-circular cross-section area which is less than the cross-sectional area of the shaft 34. The non-circular cross-section may be near-rectangular, as exemplified in FIG. 3A. At the lowermost edge of the upper end portion 31, the upper end portion 31 meets the body of the shaft 34, and there is formed a lip 39, the purpose of which will become apparent hereinbelow. The corner post 22 is provided with a reinforced portion 90 at its lower end portion 26. In the exemplary embodiment, the reinforced portion 90 is a plastic insert, which may be bonded to the interior of corner post 22. In alternate embodiments, the reinforced portion 90 may be a nonplastic insert or may be integrally molded with the corner post 22. The plastic insert may comprise a series of ribs 92 separated by grooves 94, the outer edge of the ribs 92 forming an inner surface which substantially mates with the outer surface of the shaft 34 to align the bores 33, 25. For example, an upper portion 96 of the plastic insert may be provided with a non-circular cross-sectional area which mates with the cross-sectional area of the upper end portion 31 of the shaft 34. This forces the corner post 22 to receive the shaft 34 such that the bores 33, 25 are in substantial horizontal alignment. The lowermost edge 97 of the upper portion 96 forms a notch which mates with the lip 39 of the shaft 34 to vertically align the bores 33, 25. In addition, the reinforced portion 90 may be spaced from the lower edge 28 of the corner post 22, for example, by one inch. Use of a reinforced portion 90 generally increases the rigidity and durability of the corner post 22 and corner post 22/auger base 32 coupling, and, more specifically, prevents splitting of the corner post 22 near its lower edge 28 by reducing the stress concentration at the lower end portion 26.

Referring back to FIG. 1, support members 40 include support posts 42 and auger bases 52, both of which may be constructed of materials similar to those used in constructing the corner post 22 and corner auger bases 32. Each support post 42 includes a top end portion 44, a lower end portion 46 and a lower edge 48. Each auger base 52 includes a shaft 54 and a helical blade 56. Similar to auger base 32, auger bases 52 may have a beveled end 58 and a helical blade 56 with a rounded leading edge 57. Furthermore, each support auger base 52 may be provided with an upper end portion 51 having a near-rectangular cross-sectional area and a bore so as to be interchangeable with corner post auger base 32.

The top end portion 44 of the support post 42 may be coupled to the corner member 20 using a fastener, such as a U-shaped clamp member 84. The lower end portion 46 of the support post 42 may be coupled with the auger base 52 using any one of a variety of coupling arrangements. In the exemplary embodiment, best shown in FIGS. 1 and 2, the auger shaft 54 is telescopically received by the support post 42, and adjustably coupled with the support post 42 using a stop assembly 60, for example, a ring with locking fasteners or a notch and rib assembly. The support post 42 may be provided with a reinforced portion 47 for receiving the auger shaft 52 and preventing splitting of the support post 42 as discussed earlier with the following difference: the support post reinforced portion 47 does not have an upper portion forming a ridge which would limit the depth to which the shaft 54 is received by the support post 42. This depth is adjustably limited by a stop assembly 60 as described hereinbelow.

Figure 2A:
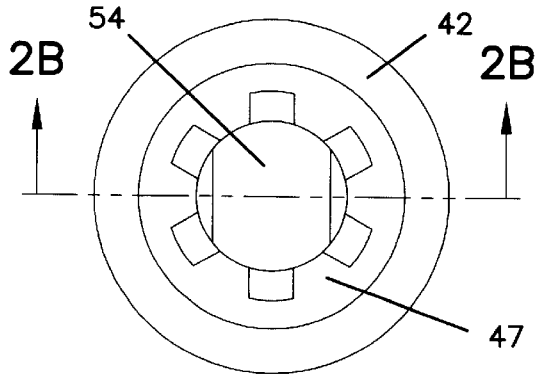
FIGS. 2A and 2B are horizontal and vertical cross-sectional views of the connecting portion of the support member shown in FIG. 1.
Figure 2B:
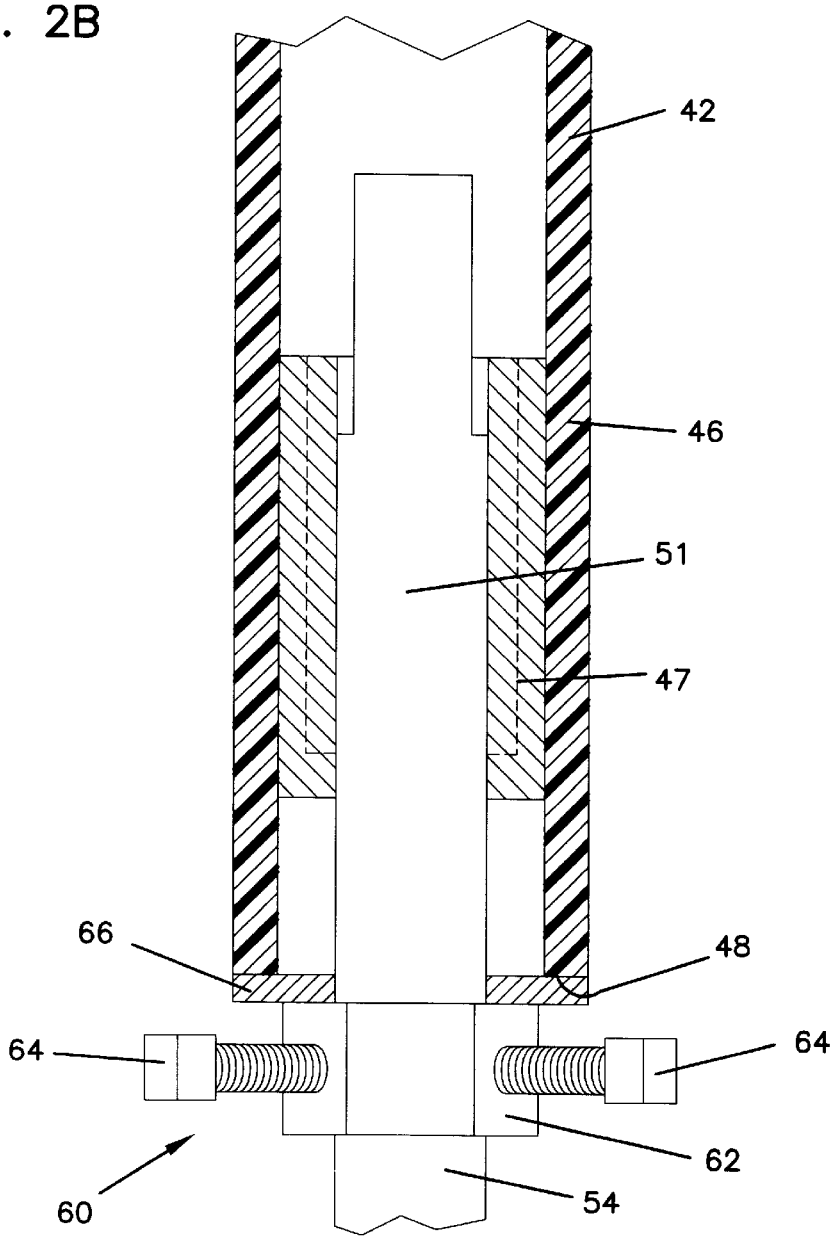

Turning now to FIGS. 2A and 2B, an exemplary stop assembly 60 is illustrated. The stop assembly 60 comprises a ring 62 and at least one locking fastener, for example, a threaded bolt 64. The stop assembly 60 is disposed between the lower edge 48 of the support post 42 and the auger blade 56 and may be provided with a washer 66 disposed between the ring 62 and the support post 42 to more evenly distribute force around the perimeter of the lower edge 48 of the support post 42, to further prevent splitting of the lower edge 48 of the support post 42, and to prevent ring 62 from sliding into the support post 42.

The stop assembly 60 may be slidably mountable on the auger shaft 54 for coupling the auger base 52 with the support post 42 and for adjusting the depth to which the auger shaft 54 is received by the support post 42. The depth may be adjusted by sliding the support post 42 and stop assembly 60 to a desired position and then securing the stop ring 62 to the shaft 54 by tightening the threaded bolts 64.

When used with a fence post apparatus 10 wherein the support posts 42 are positioned within the fenced-in area, the secured stop assembly 60 couples the auger base 52 with the support post 42 by preventing further movement of the auger shaft 54 with respect to the support post 42. The coupling or secure positioning results from the forces imparted on the fence post apparatus 10 by the fence wiring, i.e., the fence wiring forces impart an inward and downward force on the support posts 42 and stop assembly 60.

By using a slidably adjustable stop assembly, installation is facilitated, e.g., the positional relationship between the support members 40 and the corner member 20 may be adjusted by sliding the support posts 42 and stop assemblies 60 rather than turning the support augers 52 further into or out of the ground or cutting the support auger shafts 54 and/or support posts 42 to a desired length. Thus, after the corner member 20 and the support members 40 are in the ground, the support posts 42 may be easily positioned relative to the corner post such that the top ends 44 of the support posts 42 may be coupled to the corner post 22 through the use of a traditional fastener, such as a circular clamping member 82 or clamp and cap arrangement 85.

As mentioned earlier, the fence post apparatus 10 may further be provided with braces 80. Braces 80 may be horizontally positioned to and coupled between the corner post 22 and support posts 42. Braces 80 may be connected to the posts 22, 42 through the use of a suitable fastening device, such as a circular clamping member 82 as shown. The corner post 22 may be provided with wear plates 86 spaced apart along the perimeter of the corner post 22 and disposed between the corner post 22 and the fence wiring (not shown) to prevent wear on the corner post caused by movement of the fence wire. U-clips 88 may also be provided to retain the fence wire against the corner post 22 and maintain desired wire spacing.

Figure 5:
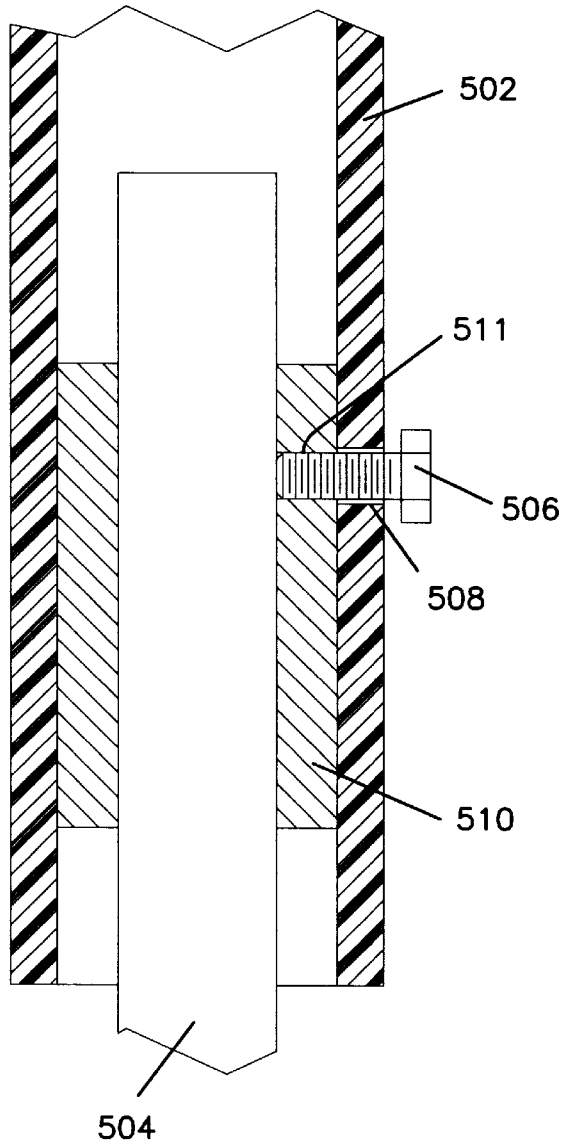
FIG. 5 is an exemplary post-auger coupling arrangement in accordance with one embodiment of the present invention.
Figure 6:
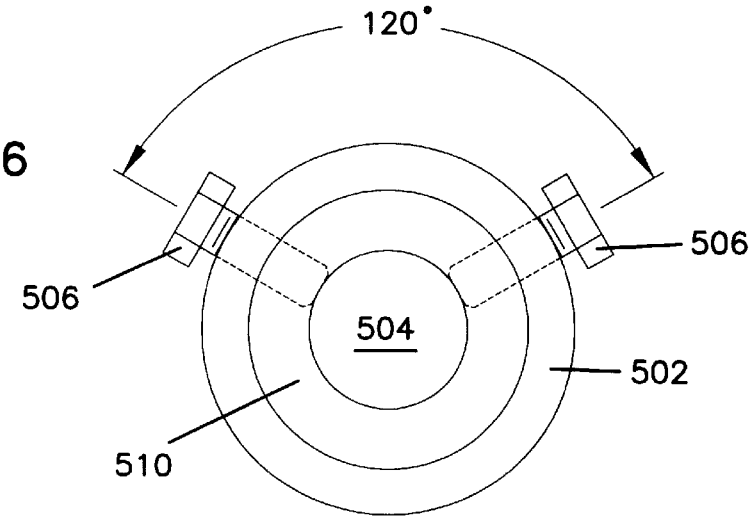
FIG. 6 is a cross-sectional view of the coupling arrangement of FIG. 5.

FIGS. 5 and 6 illustrate an exemplary coupling arrangement for coupling a fence post 502 to an auger shaft 504 in accordance with another embodiment of the invention. Similar to the coupling arrangements described above, this particular coupling arrangement may be used with the support posts and corner posts, as desired.

The coupling arrangement generally includes a stop assembly for adjusting the overall length of the auger shaft

504 and post 502 length. In this illustrative embodiment, the stop assembly includes two screws 506, each of which are disposed through a corresponding aperture 508 in the post 502 and which can be tightened against the auger shaft 504 to secure the auger shaft 504 with respect to the post 502. The two screws 506 may, for example, be separated by about 120°. The stop assembly further includes a reinforced portion 510 having one or more apertures 511, each alignable with a corresponding post aperture 508 for receiving a screw 506. Either or both of the post aperture 508 and reinforced portion aperture 511 may be threaded for receiving and retaining the screws 506. While the use of two screws is illustrated in the example embodiment, in general, one or more screws can be used without departing from the invention.

The reinforced portion 510 is generally disposed within the post 502 such that the apertures 511 align with the post apertures 508. The reinforced portion 510 may be integrally formed with the post 502 or fixed to the post 502 by, for example, bonding or welding. In one particular embodiment, the reinforced portion 510 is a removable structure, such as a bushing, which is slidably received by the post 502. An aluminum bushing would, for example, be suitable for many applications. The external and internal diameters of the reinforced portion 510 may be suitably selected in consideration of the inner diameter of the post 502 and the outer diameter of the auger shaft 504 respectfully.

It should be appreciated that the coupling arrangements disclosed herein are exemplary only. For example, in other embodiments, a portion of the auger shaft may receive a portion of the post with the portion of the shaft having apertures for receiving a screw to secure the post and the shaft together.

It will, of course, be understood that various modifications and additions can be made to the embodiments discussed herein above without parting from the scope or spirit of the present invention. Accordingly, the scope of the present invention should not be limited to the particular embodiments discussed above, but should be defined only by full and fair scope of the claims set forth below.

What is claimed is:

1. A fence post apparatus, comprising:

an upright member; and a support member including:

a support post coupled to the upright member, the support post including at least one aperture;

a support auger adjustably coupled to the support post such that the position of the support auger with respect to the support post may be adjusted, the support auger including a shaft; and a stop assembly for slidably adjusting the position of the support auger with respect to the support post, the stop assembly including at least one screw disposed through one of the at least one aperture and against the outer perimeter of the shaft to secure the support post to the support auger shaft, and a reinforced portion disposed between the auger shaft and the support post, the reinforced portion including at least one aperture alignabe with the at least one support post aperture such that the screw may be disposed through the support post aperture and the reinforced portion aperture to secure the support to the support auger shaft.

2. A fence post apparatus according to claim 1, wherein the stop assembly includes a ring disposed about the shaft and at least one bolt disposed through a bore in the ring, wherein the ring may be slidably positioned on the shaft and the bolt may be screwed to secure the ring to the support auger shaft.

3. A fence post apparatus according to claim 1, wherein the aperture of the reinforced portion includes threads for threadingly receiving the screw.

4. A fence post apparatus according to claim 1, further including a second support member having:

a support post coupled to the upright member post, and a support auger adjustably coupled to the second member support post such that the position of the second member support auger with respect to the second member support post may be adjusted.

5. A fence post apparatus according to claim 4, wherein the second support member includes a stop assembly for slidably adjusting the position of the support auger of the second support member with respect to the support post of the second support member.

6. A fence post apparatus according to claim 5, wherein the second support member support post includes at least one aperture and the second support member support auger includes a shaft, and the stop assembly includes:

at least one screw disposed through the aperture and against the outer perimeter of the shaft to secure the support post to the support auger shaft.

7. A fence post apparatus according to claim 4, further comprising at least one brace interconnecting the upright member and one of the support members.

8. A fence post apparatus, comprising:

a post having one or more apertures;

an auger having a shaft slidably received by the post;

one or more screws each disposed through a corresponding one of the one or more apertures and against a perimeter of the auger shaft; and a reinforced portion disposed between the auger shaft and the post, the reinforced portion including one or more apertures each alignable with a corresponding one of the one or more post apertures such that each screw may be disposed through one of the one or more post apertures and one of the one or more reinforced portion apertures to secure the shaft to the post;

wherein the one or more screws may be loosened and tightened such that the position of the auger with respect to the post may be slidably adjusted.

9. A fence post apparatus according to claim 8, wherein each of the one or more apertures of the reinforced portion includes threads for threadingly receiving the corresponding screw.

10. A fence post apparatus, comprising:

an upright member; and a plurality of support members, each support member including:

a support post having an upper portion coupled to the upright member and a lower portion defining one or more apertures;

a support auger having a shaft received by the lower portion of the support post;

one or more screws each disposed through a corresponding one of the one or more apertures and against an outer perimeter of the auger shaft to secure the support post to the support auger shaft; and a reinforced portion disposed between the shaft and the support post of at least one of the support members, the reinforced portion including one or more apertures each alignable with one of the one or more apertures in the support post of the at least one support member such that the one or more screws of the at least one support member may be disposed through the one or more apertures in the support post of the at least one support member and in the reinforced portion to secure the support post of the at least one support member to the support auger shaft of the at least one support member.

11. A fence post apparatus according to claim 10, wherein each of the one or more apertures of the reinforced portion includes threads for threadingly receiving the corresponding screw.

* * * * *